United States Patent [19]

Ryan

[11] Patent Number: 4,632,394

[45] Date of Patent: Dec. 30, 1986

[54] ATHLETIC SWING PLANE TRAINER

[76] Inventor: James A. Ryan, 3615 N. Grand Oaks Ct., Gurnee, Ill. 60031

[21] Appl. No.: 688,449

[22] Filed: Jan. 2, 1985

[51] Int. Cl.[4] ..... A63B 69/40

[52] U.S. Cl. ..... 273/26 E; 273/29 A; 273/58 C; 273/413

[58] Field of Search ..... 273/26 E, 29 A, 58 C, 273/413, 183 C, 184 B, 185 C, 186 B, 200 B, 200 R, 181 F, 181 J, 181 K, 182 R, 35 R, 196, 208, 319, 320, 321, 323, 335, 346, 347, 410, 413

[56] References Cited

U.S. PATENT DOCUMENTS

| | | | |
|---|---|---|---|
| 831,605 | 9/1906 | Doyle | 273/26 E |
| 1,116,555 | 11/1914 | Brewster | 273/200 |
| 1,537,809 | 5/1925 | Easton | 273/331 |
| 1,963,944 | 6/1934 | Hahn, Jr. et al. | 273/331 |
| 2,922,653 | 6/1960 | O'Brien | 273/410 |
| 3,227,451 | 1/1966 | Pruitt | 273/58 C |
| 3,351,343 | 11/1967 | Papp | 273/58 C |
| 3,709,491 | 1/1973 | Minchin | 273/58 C |
| 3,893,669 | 7/1975 | Myers | 273/26 E |
| 4,191,372 | 3/1980 | Keller | 273/29 A |
| 4,322,057 | 3/1982 | Hynes | 273/26 E |

FOREIGN PATENT DOCUMENTS

| | | | |
|---|---|---|---|
| 222226 | 10/1924 | United Kingdom | 273/181 F |
| 408944 | 4/1934 | United Kingdom | 273/181 F |

*Primary Examiner*—Richard C. Pinkham
*Assistant Examiner*—T. Brown

[57] ABSTRACT

A backstop supports a ball which is encircled by non-fabric straps whose ends overlap and are secured by pile and loop fasteners. A vertical elastic tether is fastened at one end to one of the straps and at its other end to a metal hook which detachably engages a horizontal overhead chain-link mesh portion of the backstop. The backstop also has vertical chain-link mesh portions which support targets. A transverse inelastic cord is secured at one end to a ball strap and at its other end to one of the vertical mesh portions near a target. A pole with a fork on its end is used to engage and disengage the metal hook relative to the overhead chain-link portion.

4 Claims, 21 Drawing Figures

ATHLETIC SWING PLANE TRAINER

BACKGROUND OF THE INVENTION

1. Field of the Invention

In the games of baseball and soccer, to name only two, the athlete must practice striking the ball. Pitching machines for baseball were developed, and they enabled a batter to develop his timing and swing. However, the pitching machine is expensive and cumbersome and has been the source of serious injuries. Also, it cannot place the ball precisely and repeatedly to help the batter develop a consistent swing plane.

Alternatively, and again using the games of baseball or soccer as examples, two or more athletes can practice together in a game situation. However, striking a thrown or placed ball in the open or in an enclosure does not allow sufficient rhythmic and consistent repetition for maximum training effect.

2. Description of the prior art

It is, of course, old to suspend a ball or toy for play. Doyle's "Baseball Batting Apparatus", U.S. Pat. No. 831,605 shows a simple suspended ball with elastic return cords.

Bearn's "Batting Practice Stand", U.S. Pat. No. 4,258,916 is a swinging arm apparatus with no similarity in function to my invention.

Hynes' "Batting Practice Device", U.S. Pat. No. 4,322,075 is again a swinging arm apparatus, with a cord combined with the arm. Neither of these devices allows an actual game ball to be inserted and removed, and neither allows the ball to travel away from the athlete as it would travel in game play.

The means of harnessing the actual game ball in the apparatus is a further element of my invention. It is, of course, old to fasten a cord directly to a ball or to use a netting.

In the field of playground tether balls, straps of fixed size are disclosed by Minchin's "Tether Ball Holder," U.S. Pat. No. 3,709,491 and Papp's "Game Ball and Tethering Means Therefore,"U.S. Pat. No. 3,351,343. Neither one is a sufficiently durable and safe harness for the functioning of my apparatus.

BRIEF SUMMARY OF THE INVENTION

It is the principal object of my invention to provide a training apparatus which helps the athlete to develop a consistent plane of motion while striking a ball.

It is a further object of my invention to provide a training apparatus that increases the athlete's eye quickness by allowing a struck ball to travel a short, constant and limited distance, while the athlete repeats a consistent swing plane.

It is further object of my invention to provide a training apparatus that trains the athlete in the placing of the ball during play.

An exemplary embodiment of the invention achieves the foregoing objects in a safe and durable apparatus including a suspended ball, at rest, which is then struck towards targets upon a backstop, and which then returns to the same rest position; a strong harness to hold the suspended ball; a hook with a descending inelastic cord to which the harness appends; a transverse inelastic cord which limits and dampens ball travel; and a fork used in raising and positioning the overhead hook.

DETAILED DESCRIPTION

Figure 1:
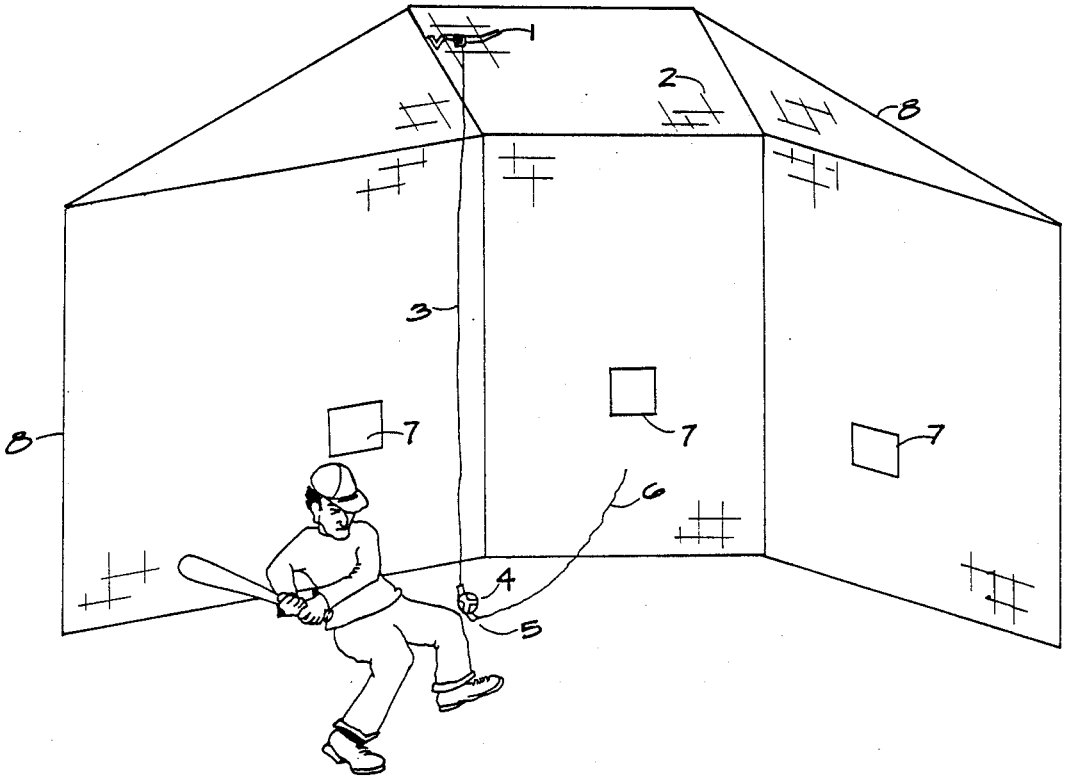
FIG. 1 is a perspective view of a batting screen and an athlete, showing a suspended ball and training targets.

Exemplary embodiments of a sports training apparatus made according to the invention are illustrated in the drawings. As illustrated in FIG. 1, there is provided a hook (1) of cold rolled metal, from which is suspended a descending inelastic cord (3) and a ball (4) encased in a harness (5). A transverse inelastic cord (6) goes from the lower portion of the harness (5) and is hooked or tied to the backstop (8). Targets (7) of a light colored material are movably arranged on the backstop. Chain-link mesh (2) is an integral part of the backstop.

Figure 2:
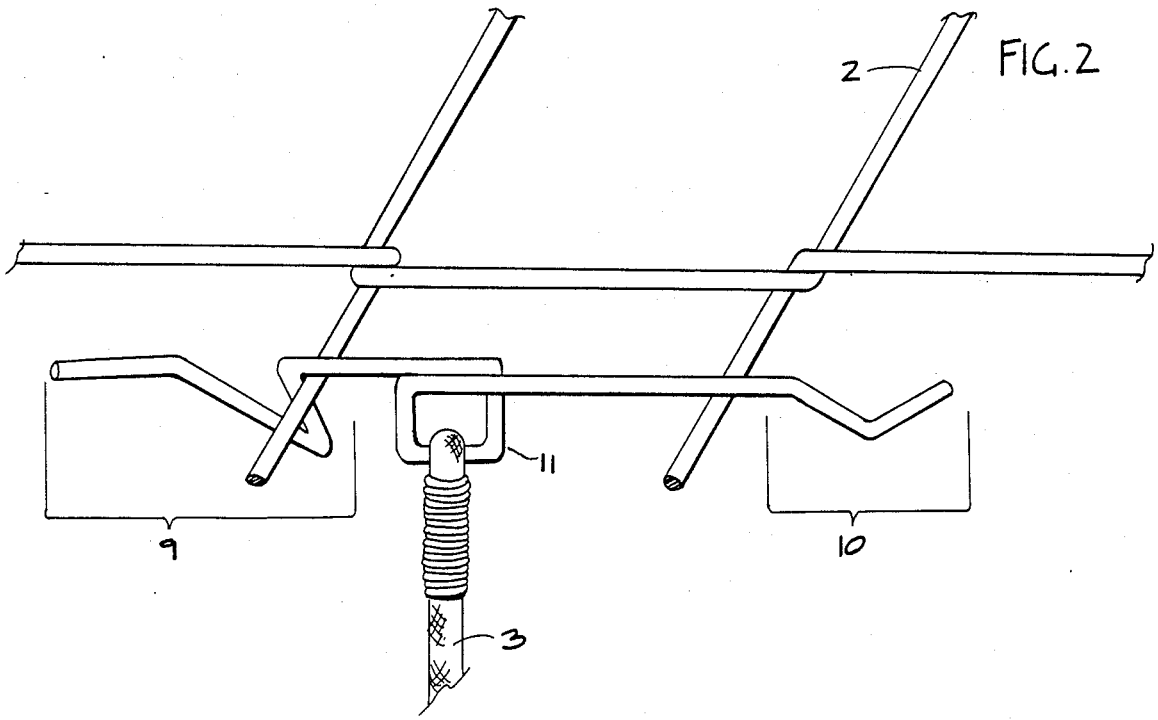
FIG. 2 is a perspective view of the overhead hook device made according to the invention, seated upon a fragment of chain-link mesh, with a descending cord attached to the hook device.

Turning now to FIG. 2, the preferred embodiment of the hook device made according to the invention is shown to be in place atop the chain-link mesh (2) which is an integral part of the backstop (8). The hook device is made of cold rolled metal and is formed with a head-piece (9) which is securely captured by the elements of the chain-link mesh when the hook device is in place atop the mesh. The mesh (2) can be either horizontal or inclined upwards from the horizontal. The tailpiece (10) of the hook device also serves to rest upon the chain-link mesh (2). The tailpiece (10) generally points down the overhead slope of and toward the rear of the back-stop (8), the rear of the backstop being the portion of the backstop upon which the targets (7) are fastened.

Figure 3:
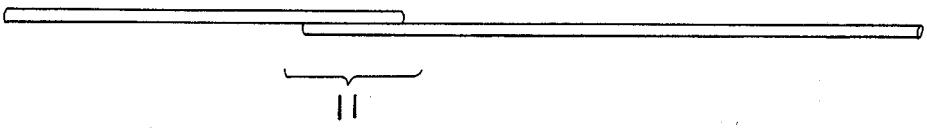
FIG. 3 is a top plan view of the hook device.
Figure 4:
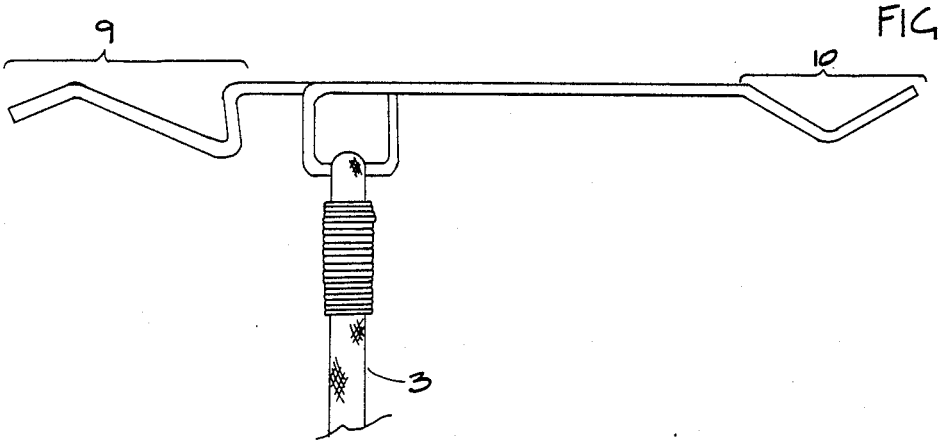
FIG. 4 is an elevation view of the hook device showing the cord which descends downward to the harnessed ball.

The hook device also includes a bend (1) which serves a place to fasten the descending cord (3). The configuration of the headpiece (9), the tailpiece (10), and the bend (11) is further illustrated in FIG. 3 and FIG. 4. The unique structural design of the hook is such that it is a continuous piece of metal configured in such a way as to interlock with the chain-link fencing material. That portion of the hook between the headpiece and the tailpiece, which includes the bend (11) for the fastening of the descending cord, is the portion of the hook which spans the interstices of a chain-link fence material. The hook therefore provides a secure point from which to suspend the harnessed ball. It can be readily understood that the configuration of the hook enables the hook to be relocated so that the harnesses ball can be positioned closer to the targets or further from the targets which are hung upon the backstop.

Figure 5:
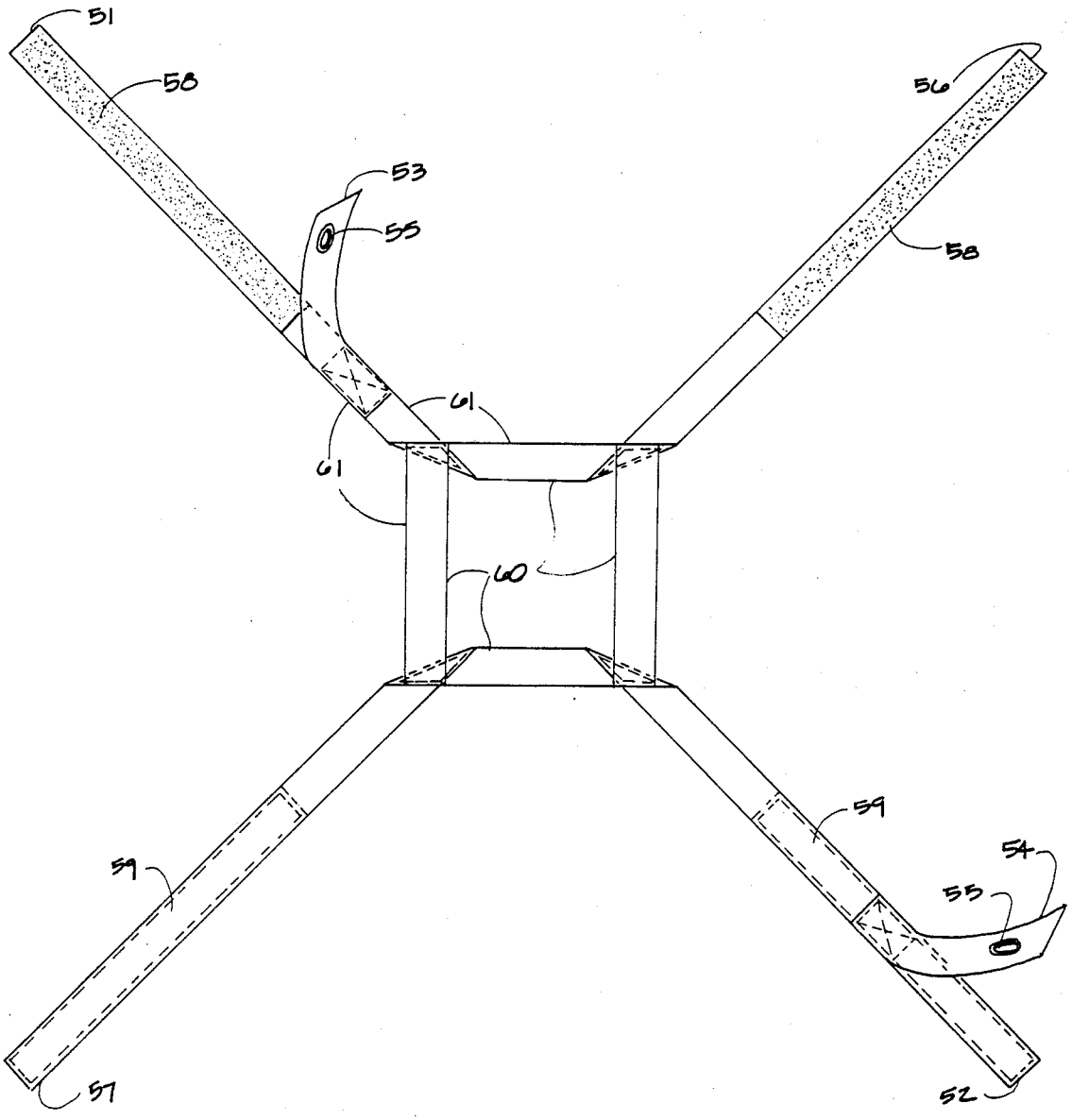
FIG. 5 is a plan view of the empty harness device laid out upon a flat surface and made according to the invention, showing the parallelogram of strapwork which leaves the face of the ball exposed after the harness is wrapped about the ball.

Turning to FIG. 5, the harness is formed of a fabric having inherent strength, durability and flexibility. The material is day-glow orange color in the preferred embodiment. The material must also be resistant to stretching or deformation, either along the direction of the weave, or along the bias of the fabric. The center of the harness comprises a parallelogram (60) fashioned of fabric strapping. Fabric strapping (51), (52), (56) and (57) extends radially from each corner of the parallelogram so as to form equal obtuse angles (61) between the extending strap and each adjacent face of the parallelogram. Two radially opposing straps (51) and (52) include grommeted tabs (53) and (54). The grommeted tab (53) is located on strap (51) immediately beyond the corner of the parallelogram.

Radially outward on the embodiment illustrated in FIG. 5, is Velcro material (58) and (59) which is attached to one face of each of the projecting fabric straps. The companion portions of the Velcro material are indicated as Velcro pile (58) and Velcro loop (59).

In the embodiment illustrated in FIG. 5, the projecting fabric strap (51) is the first strap to be wrapped around the ball which will ultimately be securely wrapped within the harness. For purposes of describing the positioning of the Velcro material on one of the two faces of the extending fabric strap, the outward face of the harness will be the face that appears in FIG. 5 and will be the face to which the grommeted tabs (53) and (54) are affixed. The other face will be referred to as the inner face.

Thus, beginning with fabric strap (51), the pile portion of the Velcro material (as distinguished from the loop portion of the Velcro material) will be securely fastened to the outer face of the fabric. The Velcro would extend from the radially outmost portion of the fabric strap, inward to the base of the grommeted tab (53). On the radially opposite fabric strap (52) the companion loop portion (59) of the Velcro material would be securely fastened to the inner face of the fabric strap, with the Velcro material being of approximately equivalent length to the companion Velcro which is attached to fabric strap (51).

As shown, there are two further fabric straps (56) and (57) extending radially outward from the central parallelogram in the center of the harness. Strap (56) has Velcro pile material (58) fixed to the outward face of the strap, extending from the extremity of the strap radially inward for a suitable distance. Strap (57) is radially opposite from strap (56), and has the companion Velcro loop (59) fastened to the inward face of said strap (57).

In the central portion of the harness assembly, a parallelogram (60) is constructed of the fabric strapping. In the preferred embodiment, two opposing sides of the parallelogram are comprised of the middle section of the lengthy pieces, continuous from the radial extremes of straps (51) and (57), and from the radial extremes of straps (52) and (56).

Two substantially shorter pieces of strapping form the final opposing sides of the parallelogram. By folding the longer strips on the half-bias, and attaching them where folded to the shorter strips, the preferred embodiment of the parallelogram is constructed and securely fastened at the corners thereof.

The best mode of attaching the folded strappings to the shorter strappings, to construct the central parallelogram, is by hand or machine stitching using a strong and durable thread.

Similarly, the best mode of attaching the Velcro material to the strapping, and of attaching the grommeted tabs to the strapping, is by means of hand or machine stitching using a strong and durable thread. The grommets (55) are affixed by hand or machine to the fabric tabs (53) and (54).

Figure 9:
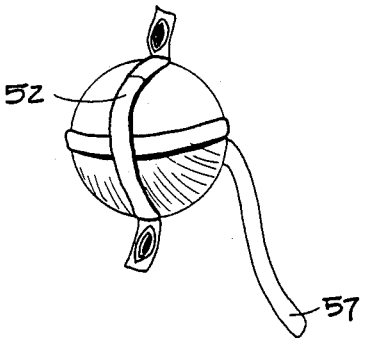
FIG. 9 illustrates, in perspective, the fourth step of the harness being wrapped about the ball.
Figure 10:
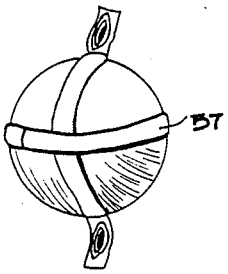
FIG. 10 illustrates, in perspective, the completely wrapped harness after the fifth step of wrapping.
Figure 11:
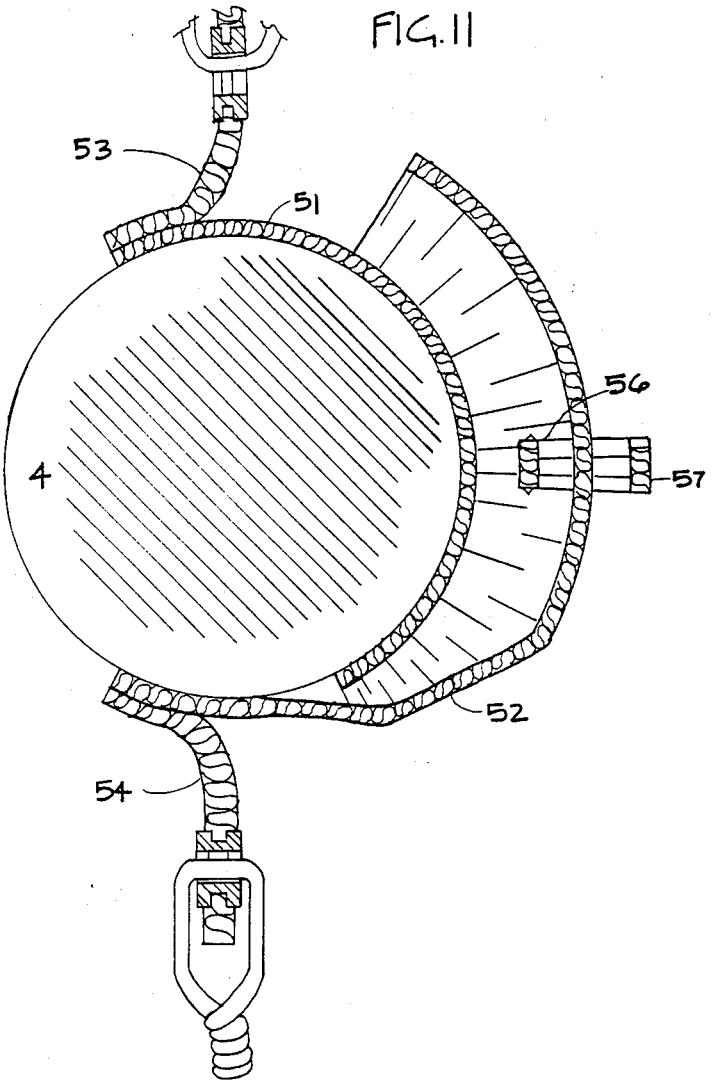
FIG. 11 is a side sectional view of the ball enclosed in the harness with cords attached to the two grommeted tabs which are made integral to the harness according to the invention.
Figure 13:
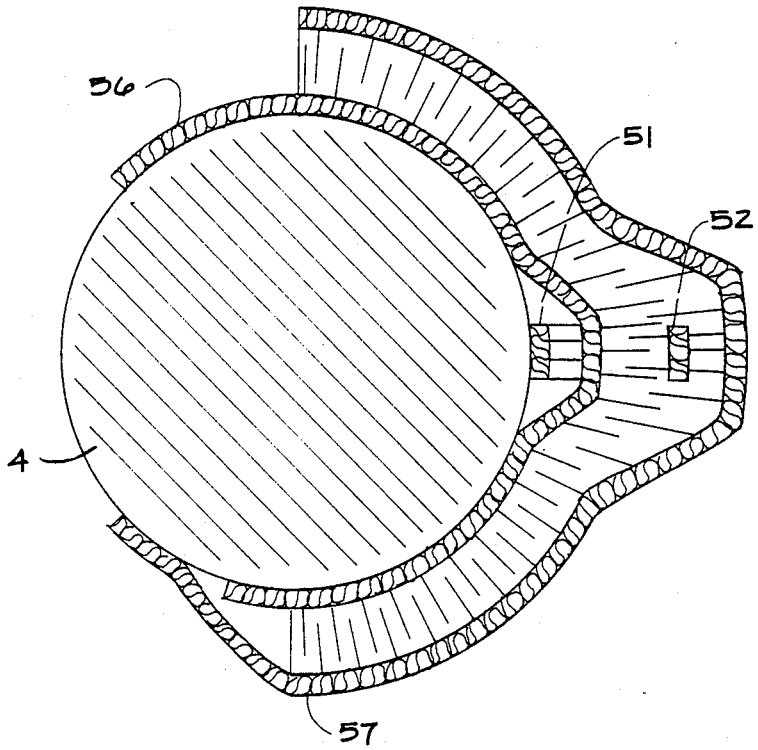
FIG. 13 is a top sectional view of the harness wrapped about the ball.

FIGS. 6, 7, 8, 9 and 10 illustrate the method of sequentially wrapping the harness strappings about the ball, in order to attain the overlap of wrappings that is further illustrated in FIGS. 11 and 13.

Figure 6:
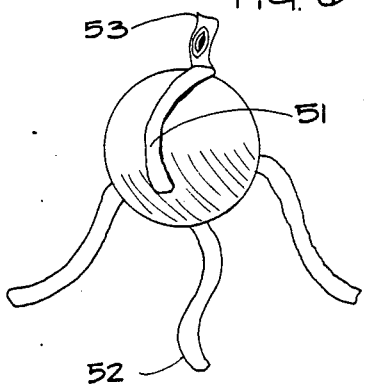
FIG. 6 illustrates, in perspective, the first step of the harness being wrapped about the ball.

In FIG. 6, a strap (51) which has Velcro pile material upon the outward face of the strapping and which has a grommeted tab (53) on the same fabric strap face as the Velcro pile, is wrapped downward along a longitudinal circumference so that the grommeted tab is at the uppermost point of the ball.

Figure 7:
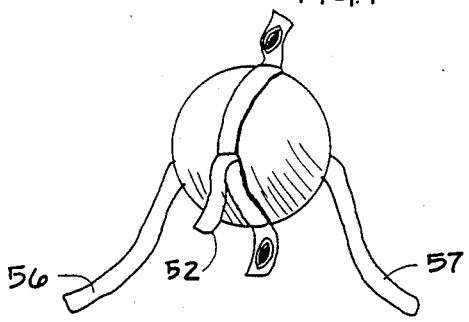
FIG. 7 illustrates, in perspective, the second step of the harness being wrapped about the ball.

FIG. 7 illustrates the next step of wrapping, which requires the radially opposite strap (52) to be brought around the bottommost portion of the ball and then upwards along the same longitudinal circumference. The Velcro loop material on the second strap (52) is pressed to the Velcro pile on strap (51). As illustrated in FIG. 7, the second strap (52) is not brought upwards above the horizontal circumference of the ball as of yet. That second strap (52) also has a grommeted tab (55).

Figure 8:
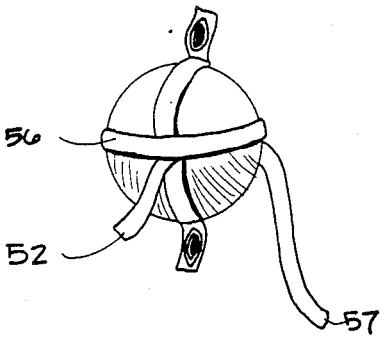
FIG. 8 illustrates, in perspective, the third step of the harness being wrapped about the ball.

FIG. 8 illustrates the next step of wrapping the harness, in which one of the latitudinal straps (56) is wrapped around the horizontal circumference of the ball with the Velcro pile facing outward.

FIG. 9 illustrates the fourth step in wrapping the harness, in which the ascending strap (52), which was only partially wrapped in FIG. 7, is now brought upwards along the longitudinal circumference of the ball to complete the circumferential wrapping that includes both of the grommeted tabs.

FIG. 10 illustrates the fifth and final step in wrapping the harness about the ball, in which the remaining latitudinal strap is brought around the horizontal circumference of the ball, said remaining strap having Velcro loop material upon the inner fabric strap face, with the Velcro loop material being used to fastened against the Velcro pile material of the prior latitudinally postitioned strap (56).

Figure 12:
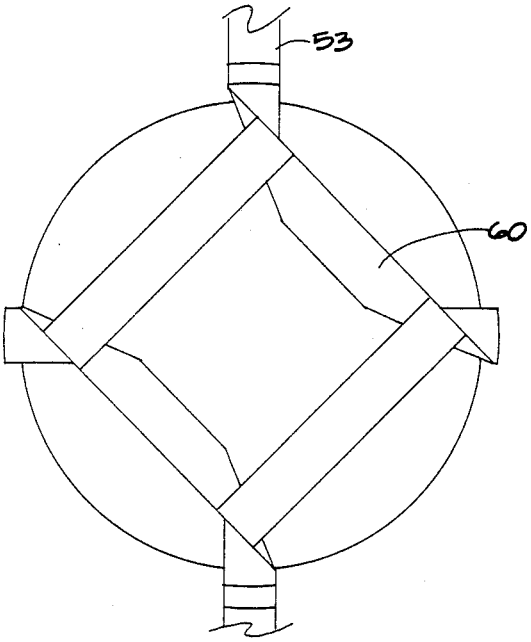
FIG. 12 is a top sectional view of the ball enclosed in the harness with the parallelogram of strapwork and the top grommeted tab illustrated.

FIG. 12 illustrates the appearance of the ball in perspective with the parallelogram (60) portion of the harness positioned on one face of the ball, and the grommeted tab (53) appearing at the uppermost portion of the ball.

FIG. 11 illustrates, in a side sectional view, the successive wrappings applied against the face of the softball opposite from the face upon which the parallelogram is situated. The reference numerals in FIG. 11 correspond to FIG. 5.

FIG. 13 illustrates, in a top sectional view, the same pattern of alternating harness wrappings about the horizontal circumference of the ball, with the point of intersection of all wrappings commencing outward from the face of the ball with the vertically descending strap being first against the face of the ball, the first horizontal strap being next positioned against the first strap, the verically ascending strap being the third strap proceeding outward from the ball at the point of intersection, and with the remaining horizontal strap being the outermost wrapping at the point of intersection. The reference numerals in FIG. 13 correspond to FIG. 5.

Figure 14:
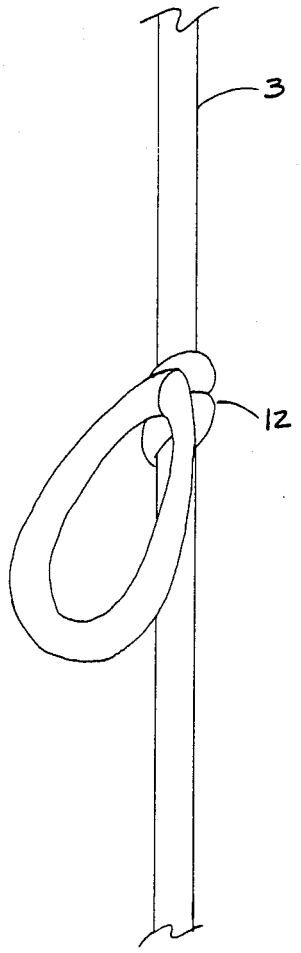
FIG. 14 is a perspective view of a bight taken in the descending cord.

FIG. 14 illustrates the bight (12) taken in the descending cord (3).

The mode of operation of the apparatus with the harnessed ball in position can be readily understood. In the preferred embodiment, the length of descending cord is adjusted by a bight which places the harnessed ball in the proper position relative to the athlete. Keeping in mind the purpose of training for a consist swing plane, the descending cord is of sufficient overall length to establish the hand, arm, foot or leg swing plane which is desirable. Also, the harnessed ball in the preferred embodiment hangs 8 to 12 feet away from the rear of the backstop upon which the targets are fastened. The targets are fastened upon the backstop in such a fashion that the extreme left hand and the extreme right hand targets are separated by a distance which is no greater than double the distance between the harnessed ball in the rear of the backstop upon which the targets are fastened. A transverse cord is affixed to the lower grommeted tab upon the harness, with the other end of the transverse cord affixed to the backstop by knotting. Adjustment of the length of the transverse cord is made so that it dampens the oscillation of the ball after the ball is propelled towards the screen, allowing the ball to quickly return to a resting position, and enabling the athlete to repeat his motion in a rhythmic fashion, without altering his stance. It will be appreciated that the progressive steps of wrapping Velcroed strapping about the ball makes this apparatus strong, durable, safe and easy to use. The athlete is able to concentrate on his plane of swing and his stance or approach to the ball.

It will also be appreciated that the placement of targets upon the backstop allows the athlete to practice placement of the ball. The functions of swing plane, together with stance or approach, are well understood as being the essential elements in any sport where the athlete must place a ball in a given location during the course of play.

It will also be appreciated that the athlete will be trained in eye quickness through the use of the apparatus. It is well understood that the athlete must keep his eyes fixed on the ball in order to make contact with the ball, whether the ball is in motion or at rest prior to being struck. However, the motion of the ball towards the athlete before being struck, or away from the athlete after being struck, can disturb the focus of the athlete's eye on the ball if the athlete involuntarily moves his head, rather than allowing the eyes alone to follow the ball's actual or anticipated motion. Because this apparatus permits motion of the ball only in constant, short and limited field of travel, the athlete will be encouraged to allow his eyes to track the ball, rather than allowing his head to move in tracking the ball.

Figure 15:
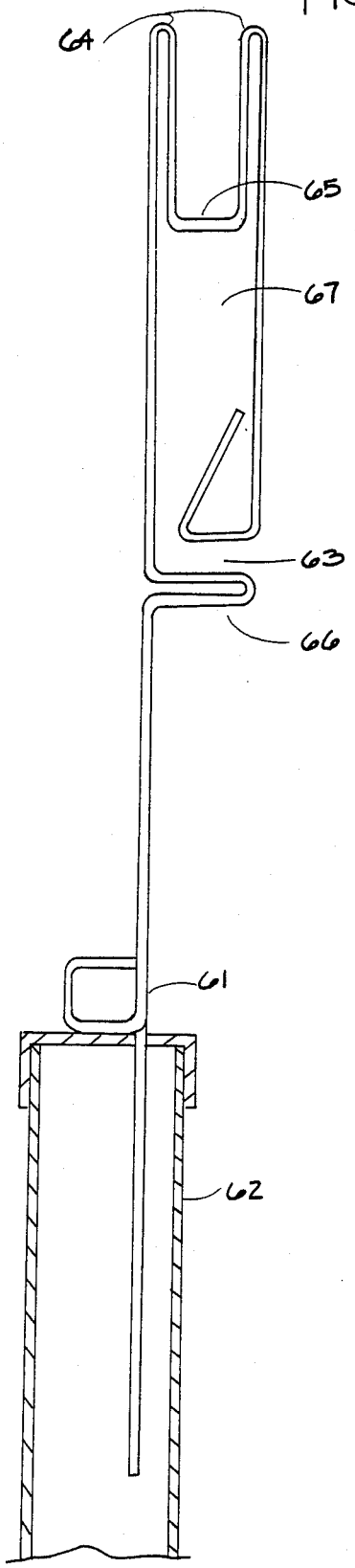
FIG. 15 is a plan view of the fork which is mounted in a pole for use in conjunction with the hook.

Turning to FIG. 15, the preferred form of fork device made according to the invention is shown inserted in a pole (62), for use together the hook device. It will be appreciated that if the apparatus is used with an existing backstop upon a playing field, it could be unsafe for the athlete to clamber up the backstop in order to fasten the hook device to which the descending cord is attached. Also, it will appreciated that the athlete may wish to move the ball so at to increase or decrease the distance between the resting ball and the targets.

In the embodiment illustrated in FIG. 15, the preferred embodiment of fork device made according to the invention is made of cold rolled metal and is formed with a bend (61) which is seated against the face of the supporting pole (62). A gate (63) and prongs (64) are furnished so as to accommodate the shape of the hook device. The distance between the prong base (65) and the gate (66) is equal to the span between the headpiece (9) and the tailpiece (10) of the companion hook device.

Figure 16:
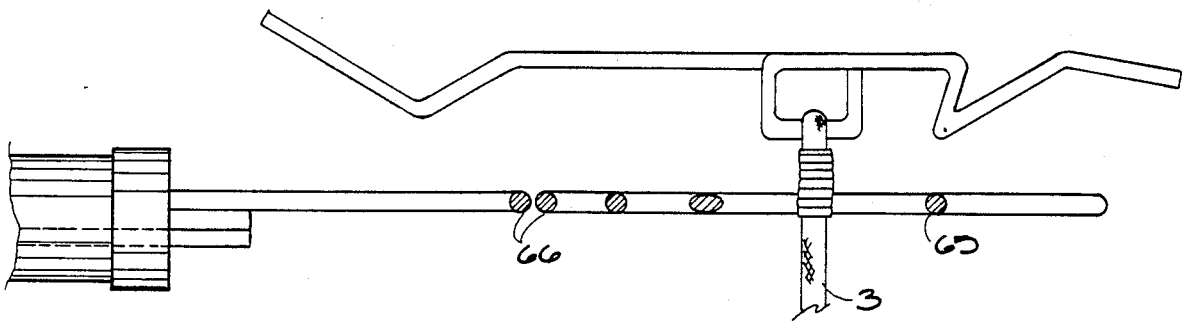
FIG. 16 is a sectional view of the fork, with an elevation view of the hook being lowered onto the fork.

FIG. 16 illustrates the hook device being lowered onto the fork device, after the cord has been routed through the gate and into the center (67) of the fork device.

Figure 17:
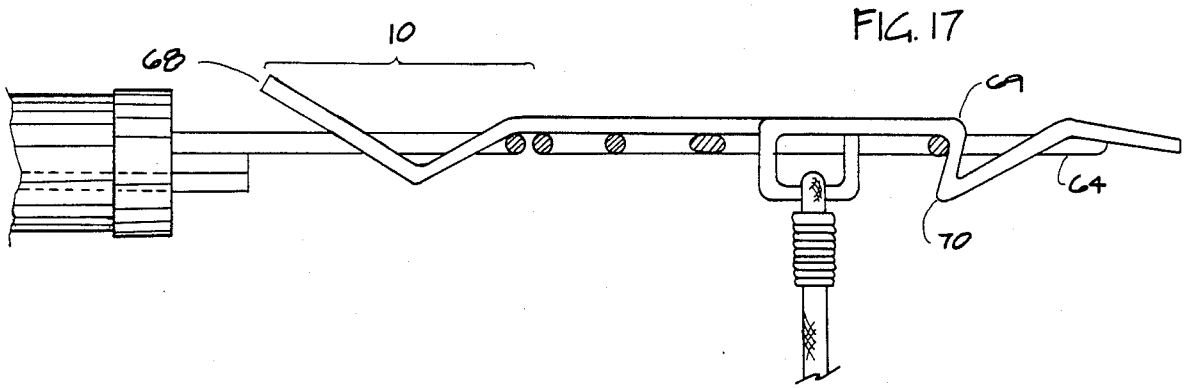
FIG. 17 is a sectional view of the fork, showing an elevation view of the hook positioned on the fork.

In FIG. 17, the hook has been seated on the fork device with the headpiece radius (69) seated against the prong base (65), the tailpiece (10) resting upon the gate base (66), the headpiece angle (70) descending between the prongs (64), and the tailpiece extremity (68) extending above the plane of the fork.

Figure 18:
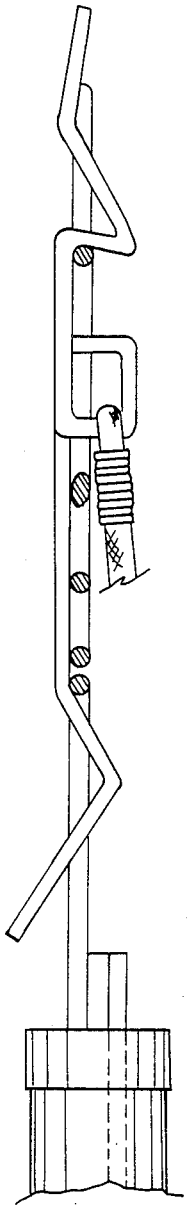
FIG. 18 is an identical view as FIG. 16, but with the fork pointed upward and the cord hanging downward against the fork.

FIG. 18 shows the combination of fork and hook pointed upward, with the fork and hook in the identical orientation as in FIG. 17. However, the descending cord is now hanging downward, preparatory to raising the fork and hook upwards through the chain mesh above.

Figure 19:
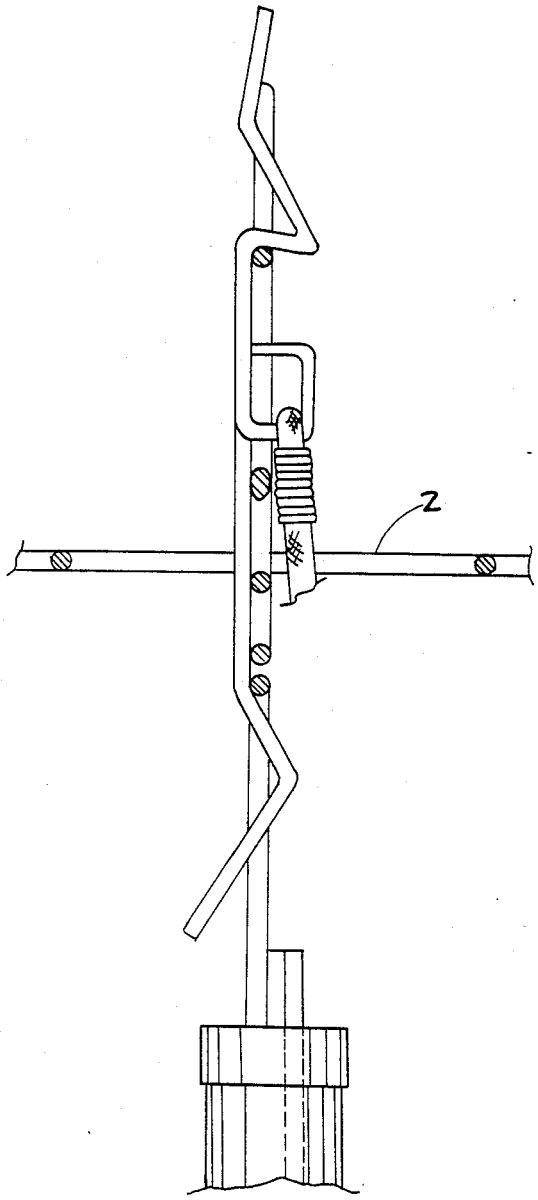
FIG. 19 is an identical view as FIG. 18, but with the fork and hook being raised upwards through the interstices of the wire mesh.

FIG. 19 shows the fork and hook assembly passing through a section of chain-link mesh (2), with the tailpiece not yet being above the chain-link mesh.

Figure 20:
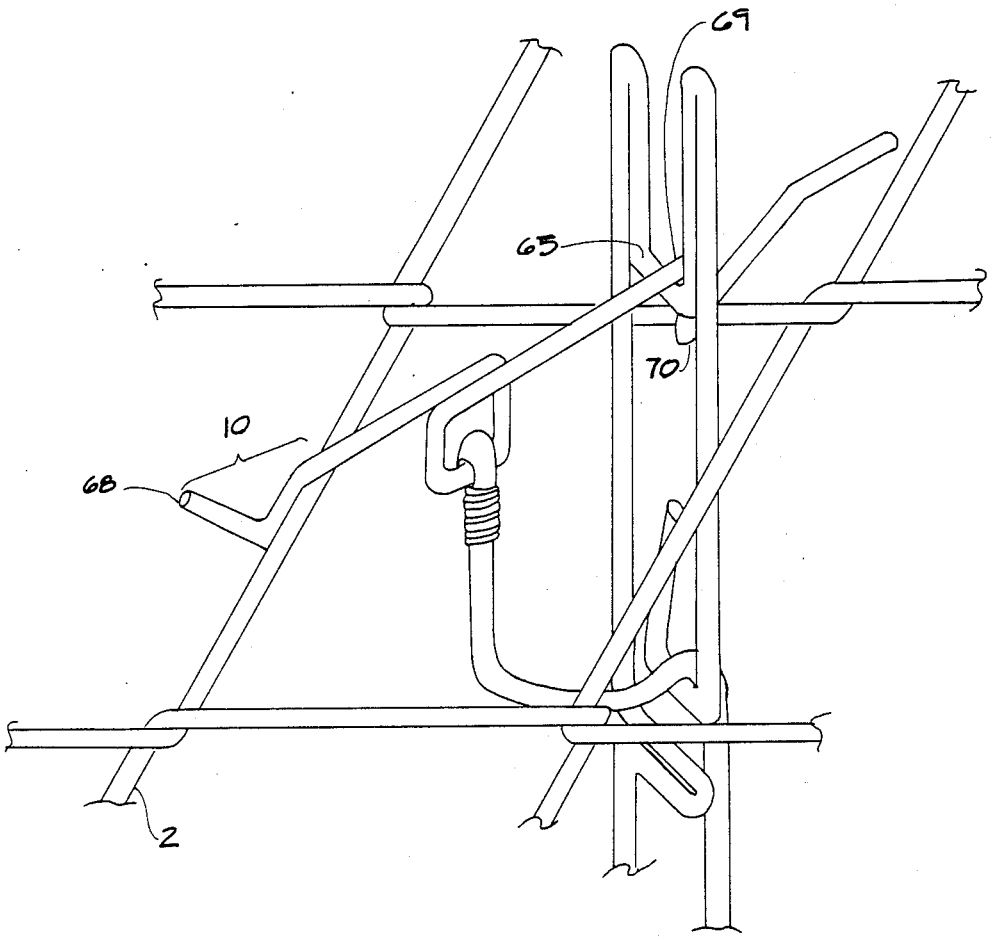
FIG. 20 is perspective view that illustrates the fork being lowered downward through the chain-link, and the hook being released from the fork by the action of the chain-link mesh-work against the tailpiece of the hook.
Figure 21:
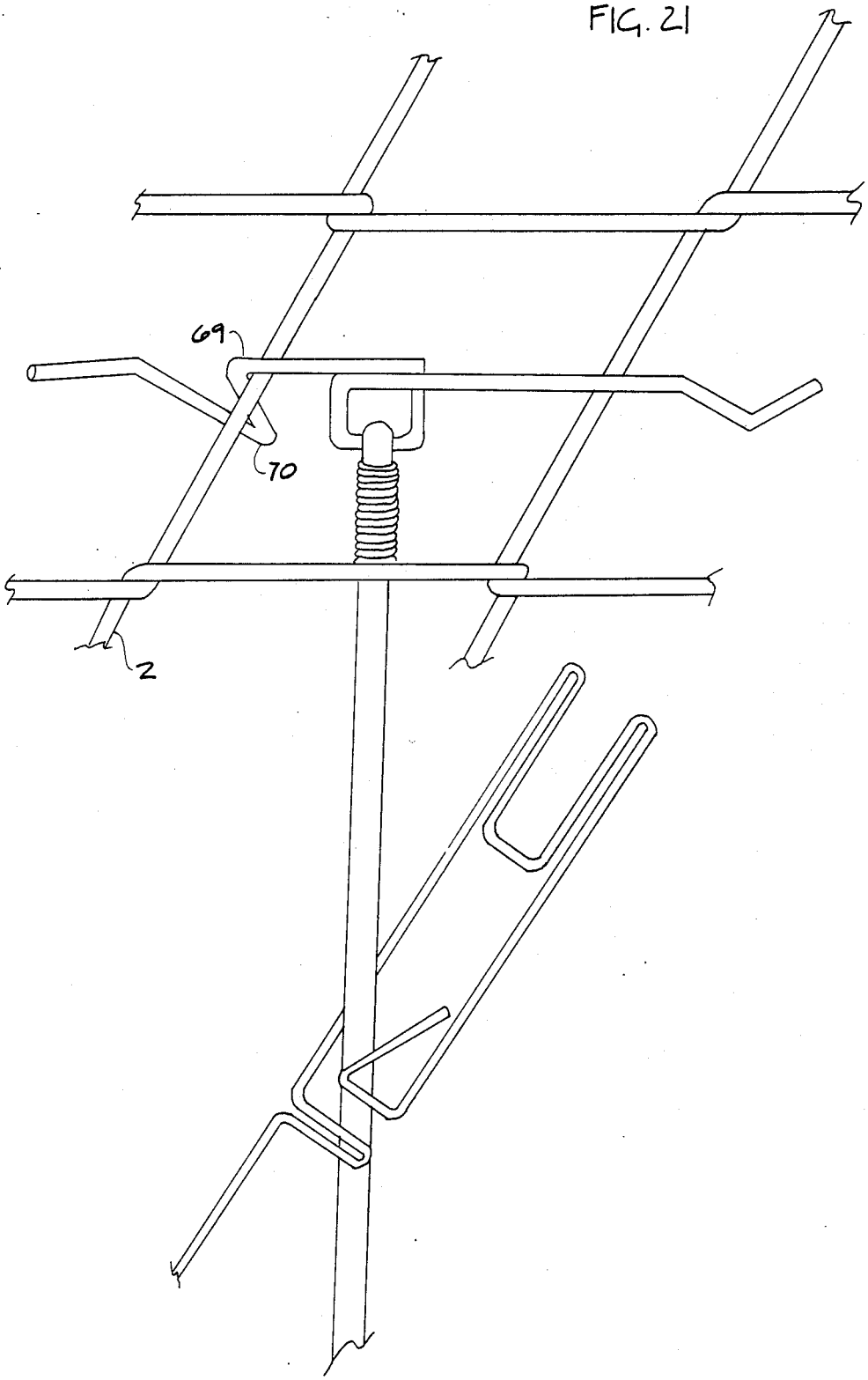
FIG. 21 is a perspective view of the hook securely positioned upon a fragment of the chain-link, with the fork being fully withdrawn downwards away from the hook, and with the descending cord still within the center of the fork.

The mode of operation of the fork and hook device can be readily understood, as illustrated in FIG. 20 and FIG. 21. The tailpiece (10) is raised through and above the chain-link mesh, and then the fork is lowered as in FIG. 20 so that the tailpiece extremity (68) catches on the chain-link mesh (2), and the tailpiece of the hook is carried away from the fork as the fork is further lowered through the chain-link mesh. The headpiece radius (69) remains seated upon the prong base (65). As the fork moves downward towards the chain-link mesh, the headpiece angle (70) will be brought to bear against the chain-link mesh, and the headpiece radius (69) will seat upon the mesh.

FIG. 21 illustrates the fork being lowered completely away from the chain-link mesh, with the headpiece radius (69) now seated against the chain-link mesh (2).

It can be readily understood that the tailpiece of the hook device will always point in the direction of the back screen, and that the headpiece radius (69) will remain seated on the chain-link mesh, and keep the headpiece angle (70) pointed toward the ground, the hook thereby remaining firmly in place.

It will, of course, be understood that various details of construction, combination and assembly may be modified throughout a range of equivalence, and it is, therefore, not the purpose to limited the scope of the present invention otherwise than as necessitated by the scope of the appended claims.

What is claimed is:

1. A tethered ball apparatus for suspension from a backstop, the backstop having substantially vertical side wall panels and substantially horizontal overhead panels attached to the side panels, the side panels and overhead panels being of chain-link mesh, said apparatus comprising an inelastic cord having a ball attached at one of its ends and a hook attached at its other end, said hook having a portion thereof configured for interengagement with the chain-link mesh of the overhead panel, of said backstop;

a ball harness attaching said ball to said one end of said inelastic cord, the harness comprising a plurality of non-stretchable fabric straps interfastened by stitching and pile and loop fasteners, with integral tabs for engaging said cord;

a plurality of targets movably positioned upon said vertical panels;

a transverse inelastic cord having one of its ends connected to said ball harness and its other end connected to one of said vertical panels;

means of raising and positioning said hook upon said overhead panel, said means comprising a fork affixed to a pole, said fork having means for supporting said hook so that said hook can be attached to said overhead panel, and said fork having means for attachment to said cord and hook and detachment from said cord and hook after said hook is attached to said overhead panel for suspending said cord and ball therefrom.

2. The suspended ball apparatus of claim 1 wherein the harness straps are day-glow orange in color.

3. The tethered ball apparatus of claim 1 wherein mounted on said vertical panels is a central target and a target to the left and right sides thereof, said tethered ball, when at rest, being suspended substantially 8 to 12 feet from said central target and a distance from said side targets not greater than twice the distance from said central target.

4. The tethered ball apparatus of claim 3 wherein said transverse inelastic cord has said other end attached to a vertical panel in substantial vertical alignment with said central target.

* * * * *